US008145089B2

(12) United States Patent
Koizumi

(10) Patent No.: US 8,145,089 B2
(45) Date of Patent: Mar. 27, 2012

(54) IMAGE FORMING APPARATUS AND METHOD OF SUPPORTING CLEANER

(75) Inventor: Susumu Koizumi, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 499 days.

(21) Appl. No.: 12/365,116

(22) Filed: Feb. 3, 2009

(65) Prior Publication Data

US 2009/0196646 A1 Aug. 6, 2009

Related U.S. Application Data

(60) Provisional application No. 61/026,103, filed on Feb. 4, 2008.

(51) Int. Cl.
*G03G 21/00* (2006.01)
*G03G 15/16* (2006.01)
*G03G 15/20* (2006.01)

(52) U.S. Cl. ..... 399/98; 399/71; 399/101; 399/123

(58) Field of Classification Search ..... 399/71, 399/98, 99, 100, 101, 123, 345
See application file for complete search history.

(56) References Cited

U.S. PATENT DOCUMENTS

| | | | | |
|---|---|---|---|---|
| 4,866,482 | A * | 9/1989 | Hirasawa et al. | 399/113 |
| 5,260,754 | A * | 11/1993 | Yano et al. | 399/123 |
| 7,266,328 | B2 * | 9/2007 | Ozawa et al. | 399/123 |
| 2007/0196125 | A1 * | 8/2007 | Koizumi et al. | 399/101 |

FOREIGN PATENT DOCUMENTS

| | | |
|---|---|---|
| JP | PH9-152823 | 6/1997 |
| JP | P2001/255750 | 9/2001 |
| JP | P2006-301545 | 11/2006 |

* cited by examiner

*Primary Examiner* — Sandra Brase
(74) *Attorney, Agent, or Firm* — Patterson & Sheridan, LLP

(57) ABSTRACT

A technique of easily detaching a cleaner with a simple configuration is provided. At the time of drawing out a drawing unit, an elastic supporting section is allowed to move against the pressing force of the elastic supporting section to a position where the elastic supporting of the cleaner is released by a support releasing section.

14 Claims, 13 Drawing Sheets

IMAGE FORMING APPARATUS AND METHOD OF SUPPORTING CLEANER

CROSS-REFERENCE TO RELATED APPLICATION

This application is based upon and claims the benefit of priority from: U.S. provisional application 61/026,103, field on Feb. 4, 2008, the entire contents of which is incorporated herein by reference.

TECHNICAL FIELD

The present invention relates to a technique of supporting a cleaner cleaning a unit that can be drawn out of a main body of an image forming apparatus.

BACKGROUND

In the past, a cleaner cleaning an intermediate transfer belt unit disposed in an image forming apparatus was fixed to an intermediate transfer belt unit or a main body of the apparatus with bolts or screws.

However, in the configuration in which the cleaner is fixed to the intermediate transfer belt unit with bolts or the like, unless the intermediate transfer belt unit is completely drawn out of the main body, the cleaner cannot be detached therefrom. Accordingly, it takes time to draw out the intermediate transfer belt unit and to detach the cleaner, thereby causing inconvenience in view of maintenance.

In the configuration in which the cleaner is fixed to the main body with bolts or the like, it is difficult to secure positional precision between the cleaner and the intermediate transfer belt unit, thereby not sufficiently exhibiting the cleaning performance.

Therefore, as described in JP-A-2001-255750, there is provided a technique of permitting the detachment of the cleaner with a lever operation without using screws or bolts.

However, in the above-mentioned technique, at the time of detaching the cleaner, it is necessary to perform the lever operation in addition to the operation of drawing out the intermediate transfer belt unit, which is troublesome. In addition, since it is necessary to provide a mechanism for permitting the attachment and detachment of the cleaner to and from the intermediate transfer belt unit with the lever operation, there is a problem that the configuration is complicated.

SUMMARY

An advantage of some aspects of the invention is that it provides a technique of easily detaching a cleaner with a simple configuration.

According to an aspect of the invention, there is provided an image forming apparatus including: a drawing unit that can be drawn out from a main body of the apparatus; a cleaner cleaning the drawing unit inserted into the main body of the apparatus at a predetermined position; an elastic supporting section elastically pressing the cleaner to elastically support the cleaner at the predetermined position in a state where the drawing unit is inserted into the main body of the apparatus; and a support releasing section moving together with the drawing unit with a drawing operation of the drawing unit and allowing the elastic supporting section to move against the pressing force of the elastic supporting section to a position where the elastic supporting of the cleaner is released at the time of drawing out the drawing unit.

According to another aspect of the invention, there is provided a cleaner supporting mechanism detachably supporting a cleaner in a target apparatus, the cleaner supporting mechanism including: a drawing unit that can be drawn out from a main body of the apparatus; a cleaner cleaning the drawing unit inserted into the main body of the apparatus at a predetermined position; an elastic supporting section elastically pressing the cleaner to elastically support the cleaner at the predetermined position in a state where the drawing unit is inserted into the main body of the apparatus; and a support releasing section moving together with the drawing unit with a drawing operation of the drawing unit and allowing the elastic supporting section to move against the pressing force of the elastic supporting section to a position where the elastic supporting of the cleaner is released at the time of drawing out the drawing unit.

According to another aspect of the invention, there is provided a method of supporting a cleaner in an image forming apparatus having a drawing unit that can be drawn out from a main body of the apparatus, a cleaner cleaning the drawing unit inserted into the main body of the apparatus at a predetermined position, an elastic supporting section elastically pressing the cleaner to elastically support the cleaner at the predetermined position in a state where the drawing unit is inserted into the main body of the apparatus, and a support releasing section moving together with the drawing unit with a drawing operation of the drawing unit. Here, the elastic supporting section is allowed to move against the pressing force of the elastic supporting section to a position where the elastic supporting of the cleaner is released at the time of drawing out the drawing unit, by the support releasing section.

DETAILED DESCRIPTION

Hereinafter, embodiments of the invention will be described with reference to the accompanying drawings.

First Embodiment

Figure 1:
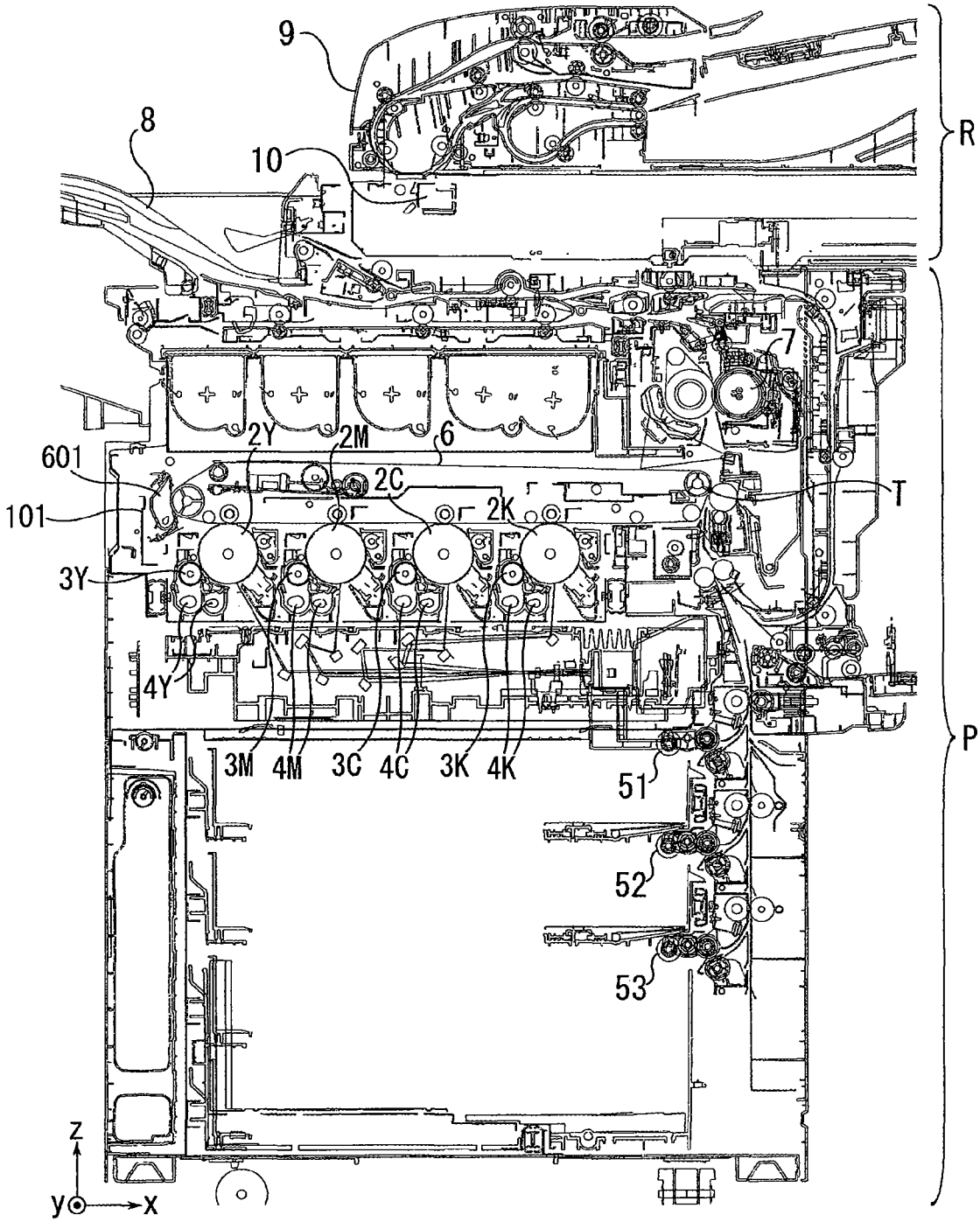
FIG. 1 is a longitudinal sectional view schematically illustrating a configuration of an image forming apparatus (MFP: Multi Function Peripheral) according to a first embodiment of the invention.

FIG. 1 is a longitudinal sectional view schematically illustrating a configuration of an image forming apparatus (MFP: Multi Function Peripheral) according to a first embodiment of the invention.

As shown in FIG. 1, the image forming apparatus according to this embodiment includes an image reading unit R and an image forming unit P.

The image reading unit R has a function of scanning and reading images of original document sheets and an original document book.

The image forming unit P has a function of forming a developer image on a sheet on the basis of the images read from the original document by the image reading unit R or image data transmitted from an external device to the image forming apparatus.

The image reading unit R has an auto document feeder (ADF) 9 automatically carrying an original document to a predetermined image reading position and reads images of an original document automatically carried by the ADF 9 or an original document placed on an original document base by the use of a scanning optical system 10.

The image forming unit P includes pickup rollers 51 to 53, photoconductive members 2Y to 2K, developing rollers 3Y to 3K, mixers 4Y to 4K, an intermediate transfer belt 6, a cleaner 601, a fixing device 7, and a sheet discharging tray 8.

A copying process will be described now as an exemplary process of the image forming apparatus according to this embodiment.

First, a sheet picked up from a cassette by the pickup rollers 51 to 53 is fed to a sheet carrying path. The sheet fed to the sheet carrying path is carried in a predetermined carrying direction by plural roller pairs.

Images of plural sheets of original documents automatically continuously carried by the ADF 9 are read at a predetermined image reading position by the scanning optical system 10.

Electrostatic latent images are formed on photoconductive surfaces of the photoconductive members 2Y, 2M, 2C, and 2K transferring developer images of yellow (Y), magenta (M), cyan (C), and black (K) on a sheet on the basis of image data of the images read from the original document by the image reading unit R.

Then, developer agitated by the mixers 4Y to 4K (corresponding to the agitation member) in the developing device is supplied to the photoconductive members 2Y to 2K having the electrostatic latent images formed thereon as described above by the developing rollers (so-called magnet rollers) 3Y to 3K. Accordingly, the electrostatic latent images formed on the photoconductive surfaces of the photoconductive members are developed.

The developer images formed on the photoconductive members in this way are transferred onto a belt surface of the intermediate transfer belt 6 (so-called primary transfer) and the developer images carried with the rotation of the intermediate transfer belt are transferred onto the carried sheets at a predetermined secondary transfer position T.

The developer images transferred onto the sheets are heated and fixed to the sheet by the fixing device 7.

The sheets to which the developer images are heated and fixed are carried along the carrying path by plural carrying roller pairs and are sequentially discharged onto the sheet discharging tray 8.

When unnecessary developer remains on the intermediate transfer belt 6, the unnecessary developer is scraped and cleaned by a cleaning blade not shown and disposed in the cleaner 601. The cleaning blade not shown is urged to a belt surface of the intermediate transfer belt 6 by a spring 602*a* (for example, see FIG. 10) to be described later.

Figure 2:
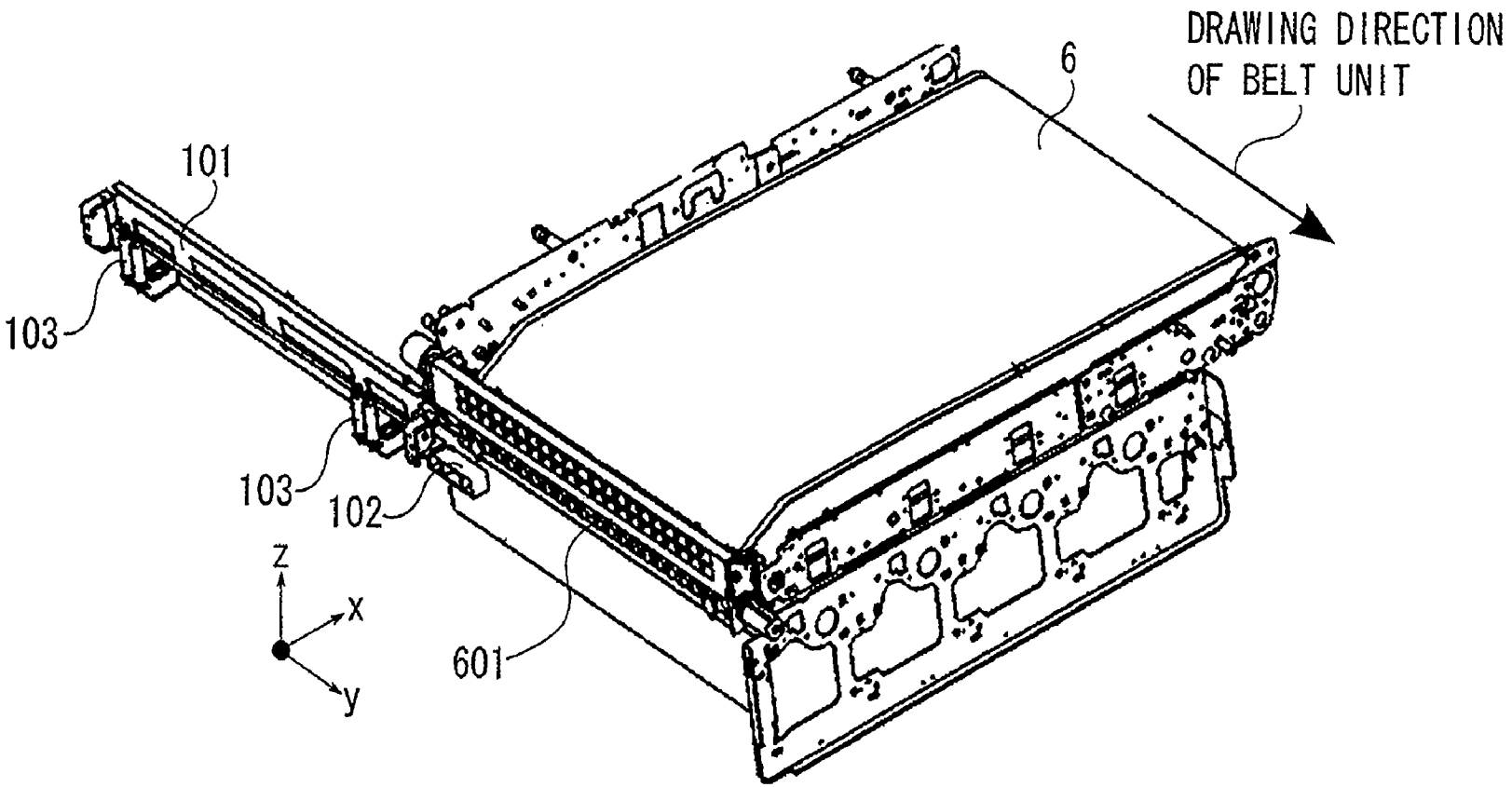
FIG. 2 is an exploded perspective view illustrating a state where an intermediate transfer belt is drawn out of a main body of the apparatus and a schematic configuration of a cleaner supporting mechanism according to the first embodiment of the invention.

The image forming apparatus according to this embodiment is configured to draw out the intermediate transfer belt 6 (corresponding to the drawing unit) from the entire surface of the apparatus by the use of a slider not shown. FIG. 2 is an exploded perspective view illustrating a state where the intermediate transfer belt 6 is drawn out of the main body of the apparatus and a schematic configuration of a cleaner supporting mechanism according to the first embodiment of the invention.

The cleaner supporting mechanism according to this embodiment detachably supports the cleaner 601 with respect to the intermediate transfer belt 6 having the above-mentioned configuration. The cleaner 601 cleans the intermediate transfer belt 6 inserted into the main body of the apparatus at a predetermined position.

Specifically, the cleaner supporting mechanism according to this embodiment includes an elastic supporting section 1 and a protruding member 102 as the support releasing member.

The elastic supporting section 1 includes a pressing member 101 and a spring 103.

Specifically, the pressing member 101 is configured to be rotatable about a rotation axis P parallel to the drawing direction of the intermediate transfer belt 6.

One end of the spring 103 is connected to the main body of the apparatus and the other end thereof is connected to the vicinity of the other end 101*a* of the pressing member 101. Accordingly, the spring 103 urges one end 101*b* of the pressing member 101 to elastically press the cleaner 601. With the action of the spring 103, the cleaner 601 is elastically pressed to the intermediate transfer belt 6 to elastically support the cleaner 601 at a predetermined position (position where the cleaner 601 can clean the intermediate transfer belt 6) in a state where the intermediate transfer belt 6 is inserted into the main body of the apparatus. In this embodiment, the spring 103 is a tension spring and the pressing member 101 is urged with the tension F generated from the spring 103 to elastically support the cleaner 601. However, the invention is not limited to the configuration, but a compression spring may be used as the spring 103.

The protruding member (support releasing section) 102 moves together with the intermediate transfer belt 6 with the drawing operation of the intermediate transfer belt 6. The protruding member 102 allows the elastic supporting section 1 (pressing member 101) to move (rotate) against the pressing force of the elastic supporting section 1 to a position where the elastic supporting of the cleaner is released at the time of drawing the intermediate transfer belt 6 (for example, see the direction of an arrow shown in FIG. 2).

A cleaner supporting method and a support releasing method of the cleaner supporting mechanism according to the first embodiment of the invention will be described in detail.

Here, a flow until the intermediate transfer belt 6 can be drawn from the main body of the apparatus and the cleaner can be detached therefrom from the state where the intermediate transfer belt 6 is inserted into the main body of the apparatus (the state where the cleaner can clean the intermediate transfer belt) will be shown and described.

Figure 3:
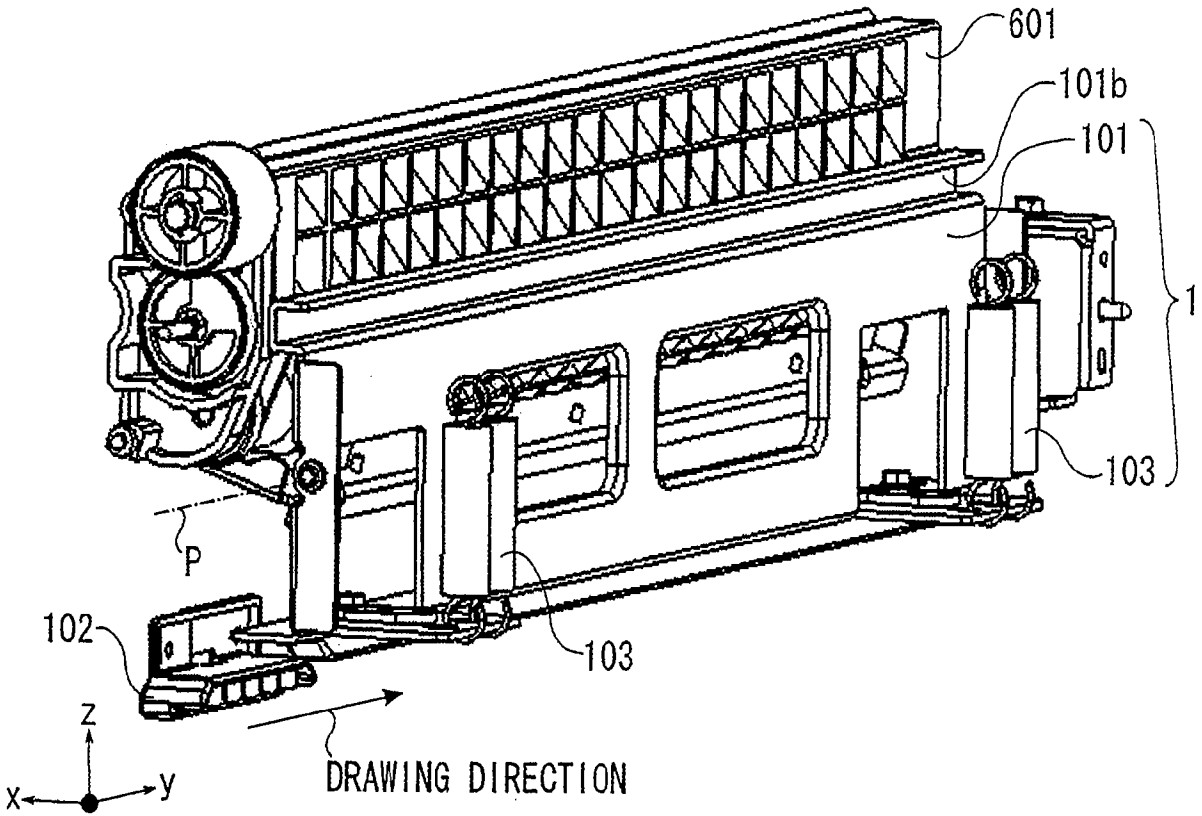
FIG. 3 is a perspective view schematically illustrating a state where a cleaner is elastically supported by an elastic supporting section.
Figure 4:
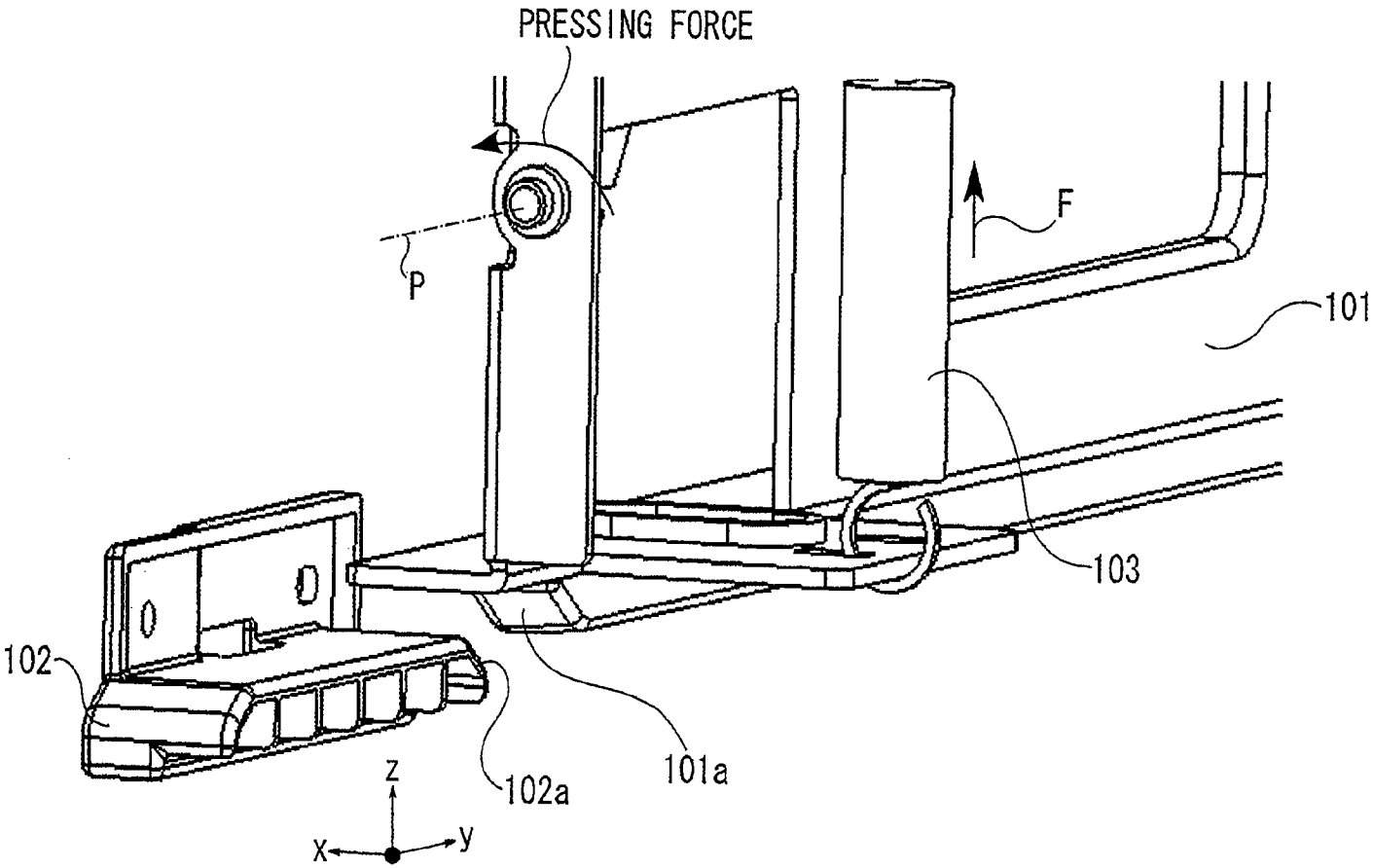
FIG. 4 is an enlarged perspective view illustrating a specific configuration in the vicinity of a protruding member shown in FIG. 3.
Figure 5:
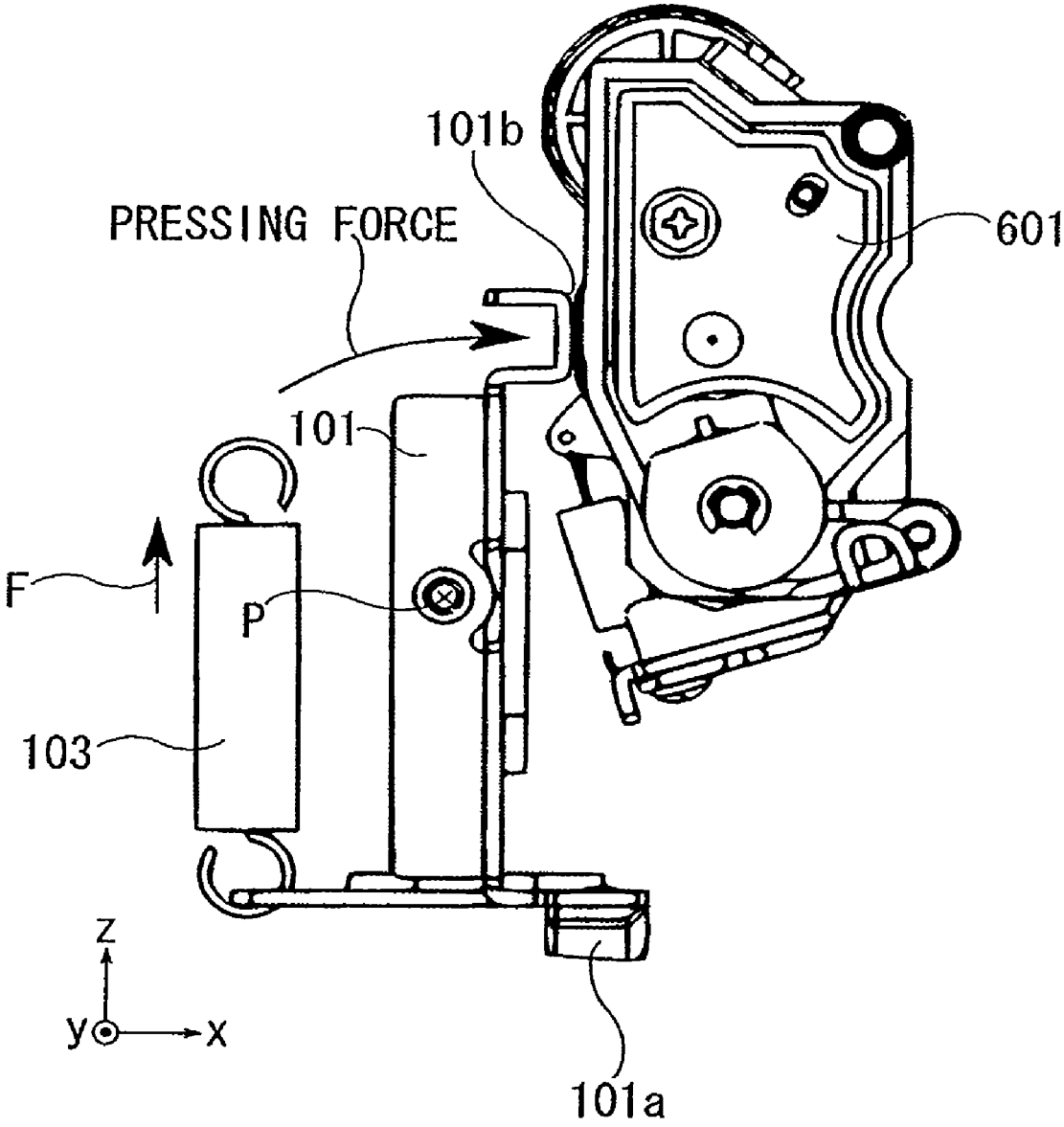
FIG. 5 is a diagram illustrating a pressing member shown in FIG. 3 as viewed from downstream to upstream in a drawing direction of the intermediate transfer belt.
Figure 6:
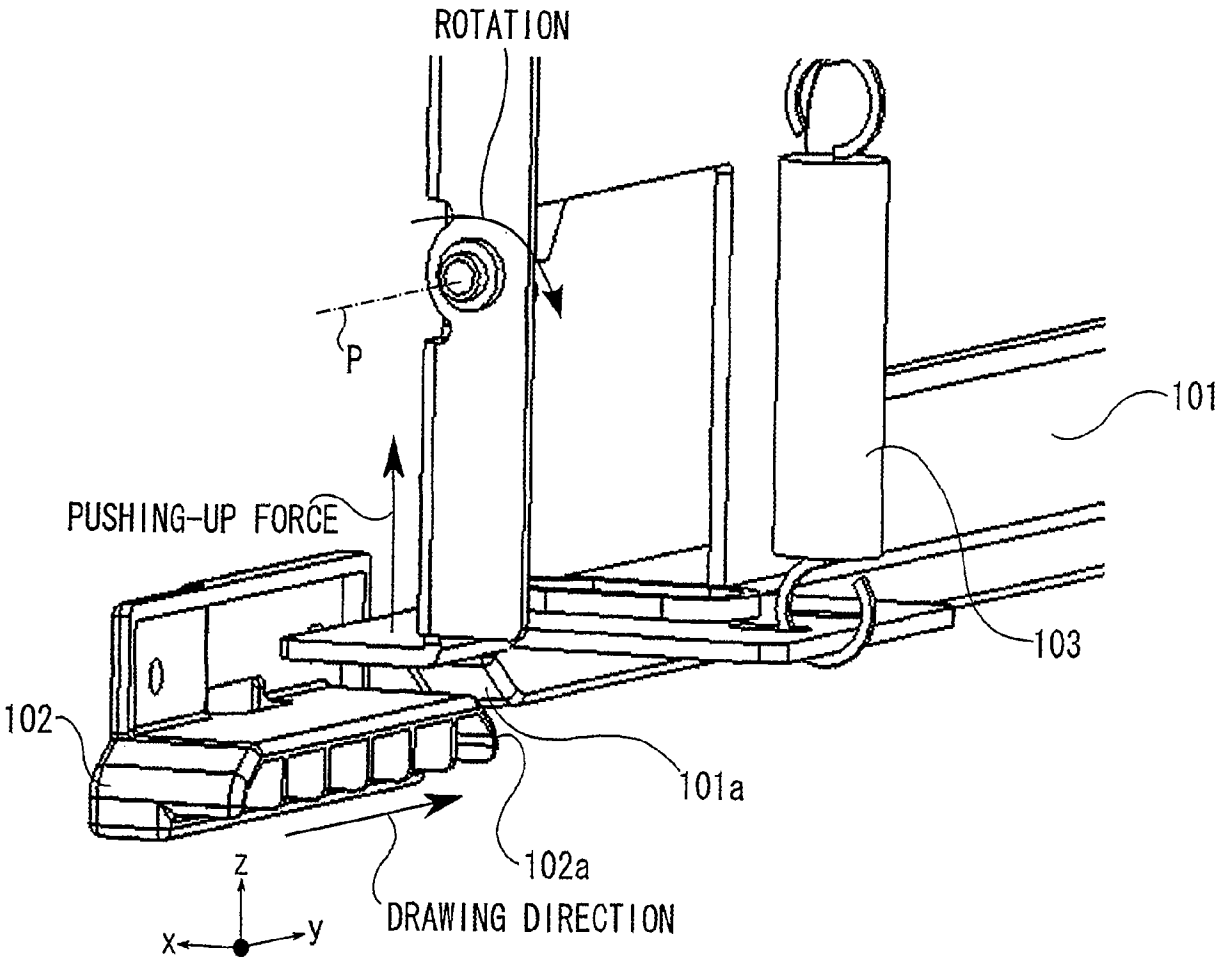
FIG. 6 is an enlarged perspective view illustrating a configuration in the vicinity of the protruding member in a state where the drawing operation of the intermediate transfer belt is started.
Figure 7:
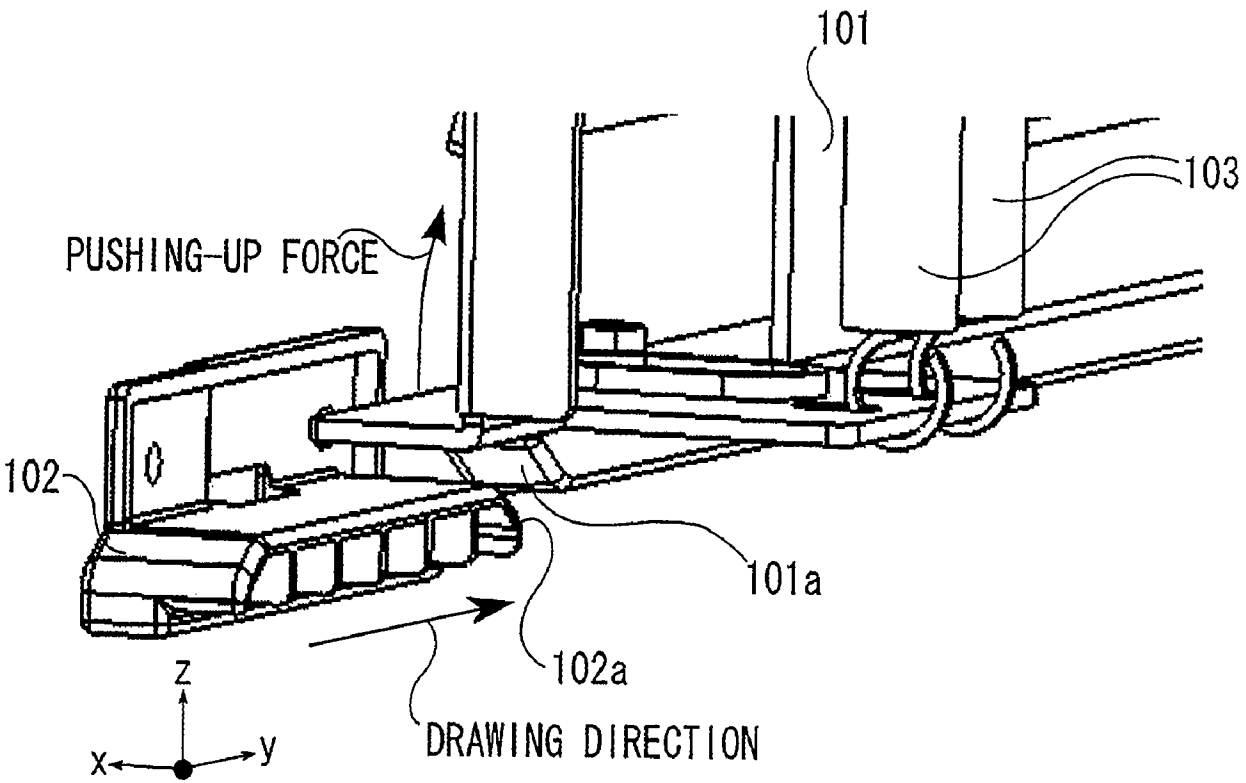
FIG. 7 is an enlarged perspective view illustrating a configuration in the vicinity of the protruding member in a state where the intermediate transfer belt is further drawn out from the state shown in FIG. 6.
Figure 8:
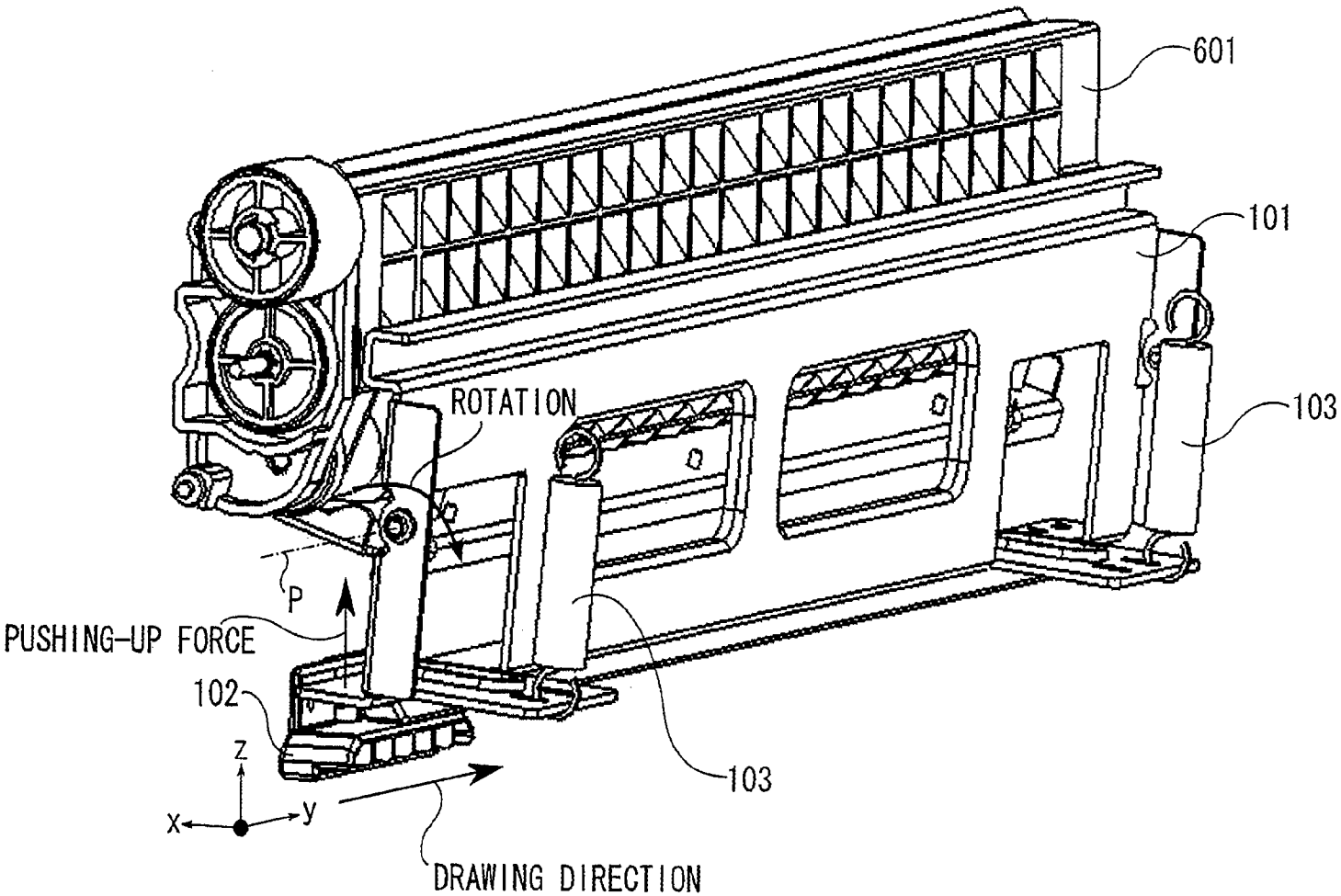
FIG. 8 is a perspective view schematically illustrating the vicinity of the elastic supporting section in a state where the elastic supporting of the cleaner is released with the drawing operation of the intermediate transfer belt.
Figure 9:
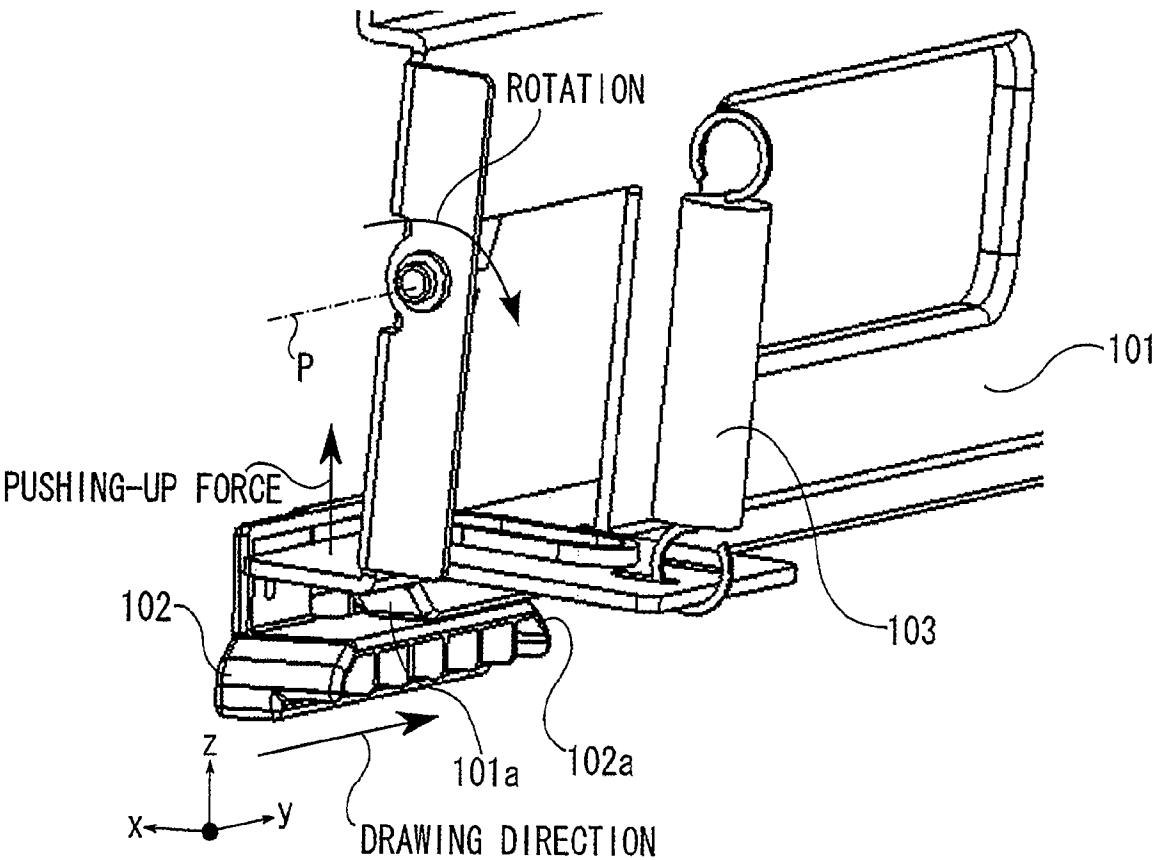
FIG. 9 is an enlarged perspective view illustrating a specific configuration in the vicinity of the protruding member shown in FIG. 8.
Figure 10:
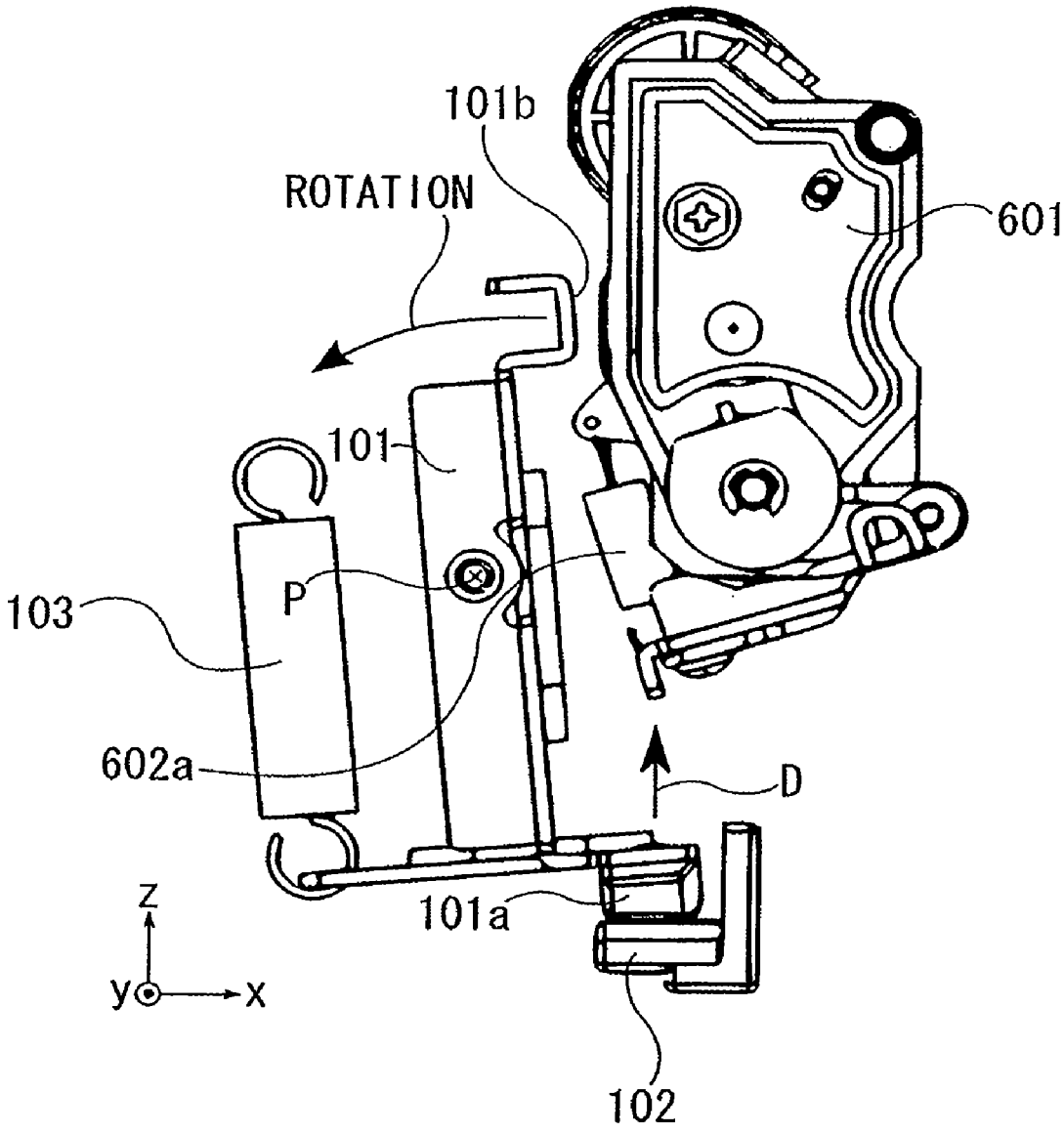
FIG. 10 is a diagram illustrating the pressing member shown in FIG. 8 as viewed from downstream to upstream in a drawing direction of the intermediate transfer belt.

FIG. 3 is a perspective view schematically illustrating a state where the cleaner is elastically supported by the elastic supporting section. FIG. 4 is an enlarged perspective view illustrating a specific configuration in the vicinity of the protruding member 102 shown in FIG. 3. FIG. 5 is a diagram illustrating the pressing member 101 shown in FIG. 3 as viewed from downstream to upstream in the drawing direction of the intermediate transfer belt. FIG. 6 is an enlarged perspective view illustrating a configuration in the vicinity of the protruding member 102 in a state where the drawing operation of the intermediate transfer belt 6 is started. FIG. 7 is an enlarged perspective view illustrating a configuration in the vicinity of the protruding member 102 in a state where the intermediate transfer belt 6 is further drawn out from the state shown in FIG. 6. FIG. 8 is a perspective view schematically illustrating the vicinity of the elastic supporting section in a state where the elastic supporting of the cleaner 601 is released with the drawing operation of the intermediate transfer belt 6. FIG. 9 is an enlarged perspective view illustrating a specific configuration in the vicinity of the protruding member 102 shown in FIG. 8. FIG. 10 is a diagram illustrating the pressing member 101 shown in FIG. 8 as viewed from downstream to upstream in a drawing direction of the intermediate transfer belt.

The state where the intermediate transfer belt 6 is inserted into the main body of the apparatus (the state where the cleaner can clean the intermediate transfer belt) will be described now.

As shown in FIGS. 3 and 4, when the intermediate transfer belt 6 is inserted into the main body of the apparatus, the protruding member 102 does not come in contact with the pressing member 101. That is, the pressing member 101 urges the cleaner 601 to the intermediate transfer belt 6 with the elastic force of the spring 103 without interference with the protruding member 102.

For example, as can be seen from FIG. 3, one end 101*b* of the pressing member of the elastic supporting section 101 extends in the drawing direction (see the direction of the arrow shown in FIG. 3) of the intermediate transfer belt 6.

According to this configuration, it is possible to increase a contact area between the elastic supporting section 1 and the cleaner 601 at the time of elastically supporting the cleaner 601 by the use of the elastic supporting section 1 (in the state shown in FIGS. 3 and 4), thereby stabilizing the elastic supporting of the cleaner 601 using the elastic supporting section 1.

A state where the intermediate transfer belt 6 is drawn out of the main body of the apparatus and the cleaner can be detached will be described now.

When the intermediate transfer belt 6 is drawn out in a predetermined drawing direction, the protruding member 102 moves together with the intermediate transfer belt 6 in the same direction.

The protruding member 102 is formed monolithically with the intermediate transfer belt 6, comes in contact with the other end 101*a* of the elastic supporting section 1 (pressing member 101) to generate a pushing-up force at the time of drawing the intermediate transfer belt 6, and allows one end 101*b* of the elastic supporting section 1 to rotate about the rotation axis P to the position where the elastic supporting of the cleaner 601 is released. Accordingly, the urging force applied to the cleaner 601 from the elastic supporting section 1 is released and thus the cleaner 601 can be detached from the intermediate transfer belt 6.

As shown in FIG. 6, the surface, which comes in contact with the protruding member 102, of the other end 101*a* of the pressing member 101 and the surface 102*a*, which comes in contact with the pressing member 101, of the protruding member 102 have a slope shape. The slope need not be formed in both the protruding member 102 and the pressing member 101 and it is sufficient if at least one has a slope shape.

According to this configuration, when the elastic supporting section 1 is allowed to rotate to the position where the elastic supporting of the cleaner 601 is released by the protruding member 102, the protruding member 102 and the elastic supporting section 1 can be made to slide on each other to smoothly transmit the pushing-up force of the protruding member 102 to the elastic supporting section 1. It is also possible to reduce the drawing resistance of the intermediate transfer belt 6 due to the contact between the contact surface 102*a* of the protruding member 102 and the other end 101*a* of the pressing member 101.

The protruding member 102 is disposed in the vicinity of the upstream end in the drawing direction of the intermediate transfer belt 6 (for example, see FIG. 2).

In this way, by disposing the protruding member 102 as the support releasing section in the vicinity of the upstream end in the drawing direction of the intermediate transfer belt 6, the state where the elastic supporting of the elastic supporting section 1 is released can be maintained when the intermediate transfer belt 6 is completely drawn out of the main body of the image forming apparatus.

In this embodiment, the other end 101*a* of the pressing member 101 continuously extends in the drawing direction of the intermediate transfer belt 6. That is, until the intermediate transfer belt unit is completely drawn out of the main body of the apparatus after the protruding member 102 starts contact with the other end 101*a* with the drawing operation of the intermediate transfer belt 6, the pushing-up force of the protruding member 102 is applied to the other end 101*a* of the pressing member 101.

Accordingly, the state where the elastic supporting of the cleaner 601 using the elastic supporting section 1 is released can be maintained while drawing the intermediate transfer belt 6.

Figure 11:
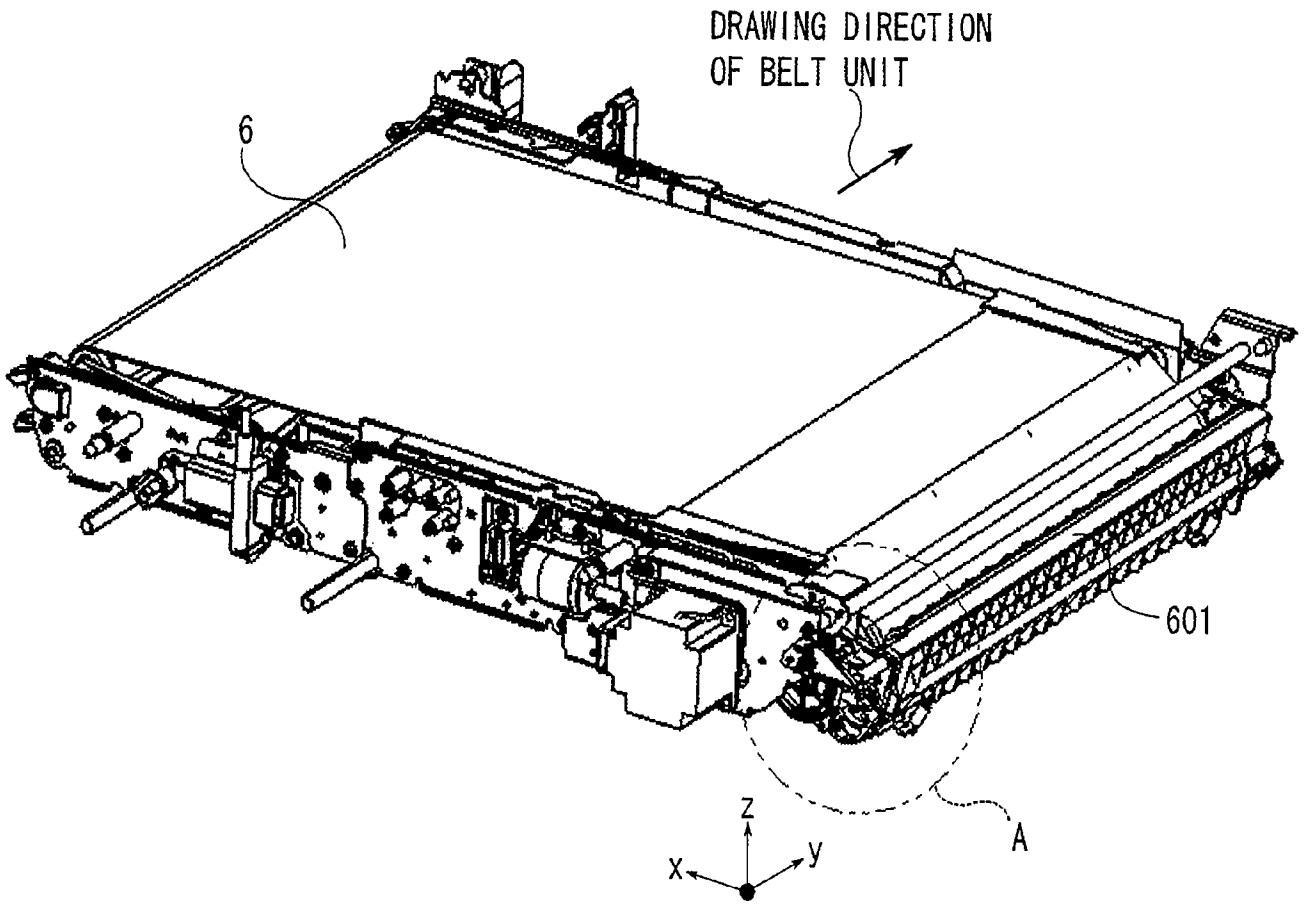
FIG. 11 is a perspective view schematically illustrating a supporting structure of the cleaner to the intermediate transfer belt.
Figure 12:
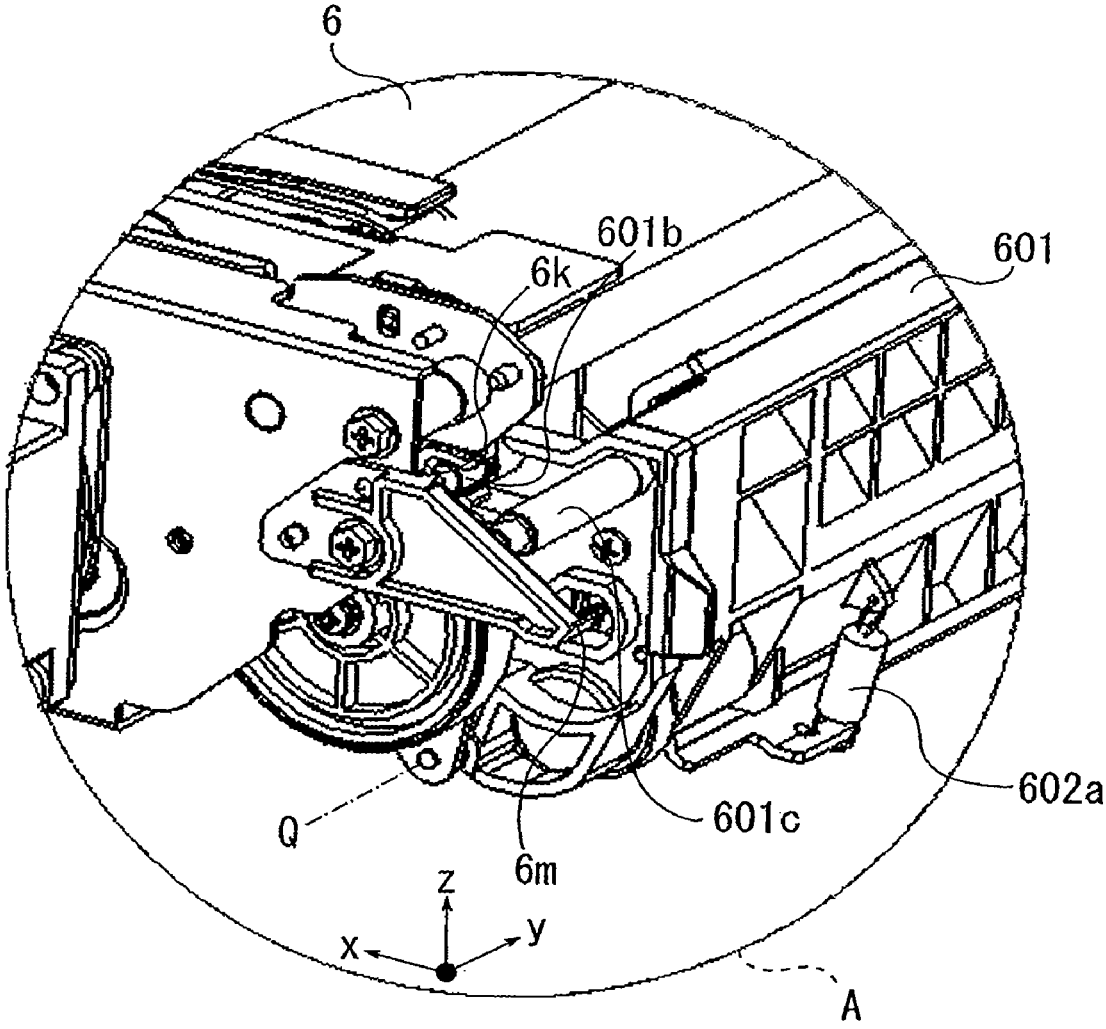
FIG. 12 is an enlarged perspective view illustrating the supporting structure of the cleaner to the intermediate transfer belt in a state where the cleaner is elastically supported.
Figure 13:
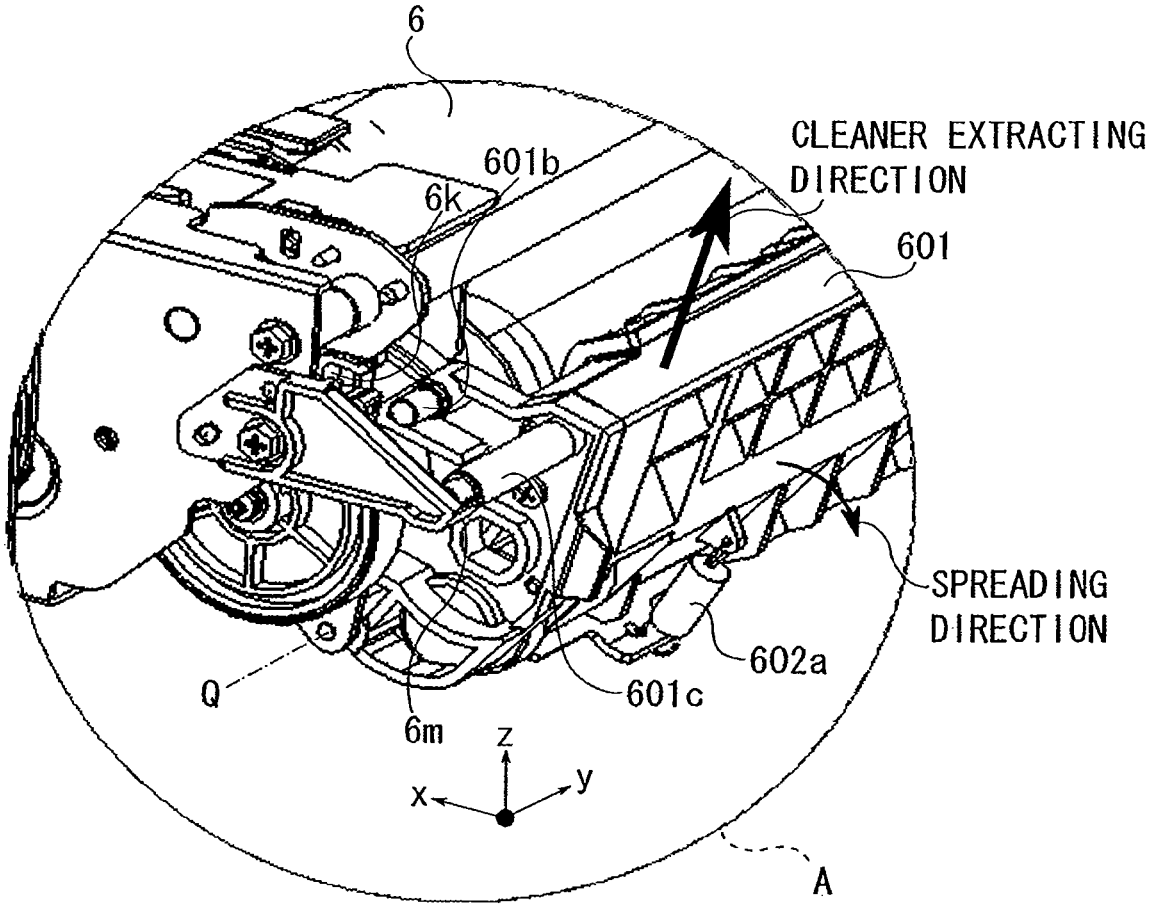
FIG. 13 is an enlarged perspective view illustrating the supporting structure of the cleaner to the intermediate transfer belt in a state where the elastic supporting is released.

FIG. 11 is a perspective view schematically illustrating a supporting structure of the cleaner 601 to the intermediate transfer belt 6. FIG. 12 is an enlarged perspective view illustrating the supporting structure of the cleaner 601 to the intermediate transfer belt 6 in a state where the cleaner 601 is elastically supported. FIG. 13 is an enlarged perspective view illustrating the supporting structure of the cleaner 601 to the intermediate transfer belt 6 in a state where the elastic supporting is released.

The cleaner 601 has locking shafts 601*b* and 601*c* extending in the direction of the rotation axis P on both end surfaces in the direction of the rotation axis P.

The intermediate transfer belt 6 has engaging portions 6*k* and 6*m* engaging with the locking shafts 601*b* and 601*c*. Here, the engaging portion 6*m* corresponds to the supporting member.

As shown in FIG. 12, the cleaner 601 elastically supported by the elastic supporting section 1 is pressed in the direction in which it comes in contact with the intermediate transfer belt 6 with the pressing force of the elastic supporting section 1 and the locking shaft 601*b* engages with the engaging portion 6*k* of the intermediate transfer belt 6 by means of the pressing force of the elastic supporting section 1, whereby the cleaner 601 is positioned at a predetermined position relative to the intermediate transfer belt 6.

As shown in FIG. 13, the cleaner 601 of which the elastic supporting using the elastic supporting section 1 is released is spread in a direction in which it gets apart from the intermediate transfer belt 6 about the rotation axis Q. The cleaner 601 of which the elastic supporting using the elastic supporting section 1 is released in this way is supported not to drop in the state where the locking shaft 601*c* is inserted into the engaging portion 6*m* and it is spread at a predetermined angle. In this state, the cleaner 601 can be extracted in the cleaner extracting direction shown in FIG. 13.

According to this configuration, the cleaner that can be detached from the intermediate transfer belt unit does not erroneously drop at the time of drawing out the intermediate transfer belt unit as the intermediate transfer belt 6 from the main body of the apparatus, thereby contributing to the improvement in operation ability.

According to the first embodiment of the invention, by only drawing the intermediate transfer belt 6 (drawing unit) to be cleaned by the cleaner 601 from the main body of the apparatus in the state where it is inserted into the main body of the image forming apparatus, the fixation of the cleaner 601 is released with the drawing operation without operating a specific tool such as a driver or a complex mechanism such as a release lever, thereby the cleaner 601 is easily detached.

Accordingly, it is not necessary to provide a complex mechanism for the position fixation (supporting) of the cleaner 601 to the intermediate transfer belt 6 or the detachment from the intermediate transfer belt 6 and it is advantageous in view of durability or economical efficiency.

Of course, similarly at the time of inserting the intermediate transfer belt 6 into the main body of the image forming apparatus, the protruding member 102 and the other end 101*a* come in contact with each other with the inserting operation of the intermediate transfer belt 6, whereby the elastic supporting using the pressing member 101 is released. Accordingly, it is possible to smoothly insert the intermediate transfer belt 6 without contact of the pressing member 101 with the cleaner 601.

Second Embodiment

A second embodiment of the invention will be described now.

The second embodiment of the invention is a modified example of the above-mentioned first embodiment. The second embodiment is different from the first embodiment, in that the photoconductive member instead of the intermediate transfer belt unit is to be cleaned by the detachable cleaner.

Hereinafter, elements having the same functions as described in the first embodiment are referenced by the same reference numerals and description thereof is omitted.

Although it is described above in the first embodiment that the cleaner cleaning the belt surface of the intermediate transfer belt can be detached with the operation of drawing the intermediate transfer belt unit from the apparatus, the invention is not limited to the configuration.

The image forming apparatus according to this embodiment may include a photoconductive member that can be drawn out from a main body of the apparatus; a cleaner cleaning the photoconductive member inserted into the main body of the apparatus at a predetermined position; an elastic supporting section elastically pressing the cleaner to elastically support the cleaner at the predetermined position in a state where the photoconductive member is inserted into the main body of the apparatus; and a support releasing section moving together with the photoconductive member with a drawing operation of the photoconductive member and allowing the elastic supporting section to move against the pressing force of the elastic supporting section to a position where the elastic supporting of the cleaner is released at the time of drawing out the photoconductive member.

Although it is described in the above-mentioned embodiments that a coil spring is employed to urge the pressing member 101, the invention is not limited to the configuration. Any configuration may be employed as long as it can embody the elastic supporting of the cleaner 601 using the pressing member 101 having the rotation axis P as the rotation center. For example, the pressing member 101 may be urged by the use of rubber, sponge, a leaf spring, or the like.

Although the invention is described above with reference to the specific embodiments, it will be apparent to those skilled in the art that the invention can be modified in various forms without departing from the spirit and scope of the invention.

According to the above-mentioned invention, it is possible to provide the technique of easily detaching the cleaner with a simple configuration.

What is claimed is:

1. An image forming apparatus comprising:

a drawing unit that can be drawn out from a main body of the apparatus;

a cleaner for cleaning the drawing unit inserted into the main body of the apparatus at a predetermined position;

an elastic supporting section elastically pressing the cleaner to elastically support the cleaner at the predetermined position in a state where the drawing unit is inserted into the main body of the apparatus, the elastic supporting section being rotatable about an axis that is parallel to a drawing direction of the drawing unit and having an end that elastically presses the cleaner to elastically support the cleaner; and a support releasing section moving together with the drawing unit during a drawing operation of the drawing unit and allowing the elastic supporting section to move against the pressing force of the elastic supporting section to a position where the elastic supporting of the cleaner by the elastic supporting section is released at the time the drawing unit is being drawn out, the support releasing section being a protruding member that is formed monolithically with the drawing unit and that comes in contact with another end of the elastic supporting section at the time the drawing unit is being drawn out to allow the elastic supporting section to rotate up to the position where the elastic supporting of the cleaner is released.

2. The apparatus according to claim 1, wherein an end surface of at least one of the elastic supporting section and the protruding member has a slope shape.

3. The apparatus according to claim 1, wherein the support releasing section is disposed in the vicinity of an upstream end in the drawing direction of the drawing unit.

4. The apparatus according to claim 1, wherein one end of the elastic supporting section extends in the drawing direction of the drawing unit.

5. The apparatus according to claim 1, wherein the drawing unit includes a supporting member detachably supporting the cleaner in a state where the elastic supporting of the cleaner is released.

6. The apparatus according to claim 1, wherein the drawing unit is an intermediate transfer belt.

7. The apparatus according to claim 1, wherein the drawing unit is a photoconductive member.

8. A method of supporting a cleaner in an image forming apparatus having a drawing unit that can be drawn out from a main body of the apparatus, a cleaner for cleaning the drawing unit inserted into the main body of the apparatus at a predetermined position, an elastic supporting section elastically pressing the cleaner to elastically support the cleaner at the predetermined position in a state where the drawing unit is inserted into the main body of the apparatus, the elastic supporting section being rotatable about an axis that is parallel to a drawing direction of the drawing unit and having an end that elastically presses the cleaner to elastically support the cleaner, and a support releasing section monolithically moving together with the drawing unit during a drawing operation of the drawing unit, and the support releasing section being a protruding member that is formed monolithically with the drawing unit and that comes in contact with another end of the elastic supporting section at the time the drawing unit is being drawn out to allow the elastic supporting section to rotate up to the position where the elastic supporting of the cleaner is released, wherein the elastic supporting section is allowed to move against the pressing force of the elastic supporting section to a position where the elastic supporting of the cleaner by the elastic supporting section is released at the time the drawing unit is being drawn out, by the support releasing section.

9. The method according to claim 8, wherein an end surface of at least one of the elastic supporting section and the protruding member has a slope shape.

10. The method according to claim 8, wherein the support releasing section is disposed in the vicinity of an upstream end in the drawing direction of the drawing unit.

11. The method according to claim 8, wherein one end of the elastic supporting section extends in the drawing direction of the drawing unit.

12. The method according to claim 8, wherein the drawing unit includes a supporting member detachably supporting the cleaner in a state where the elastic supporting of the cleaner is released.

13. The method according to claim 8, wherein the drawing unit is an intermediate transfer belt.

14. The method according to claim 8, wherein the drawing unit is a photoconductive member.

* * * * *